US005384193A

United States Patent [19]

Suh et al.

[11] Patent Number: 5,384,193

[45] Date of Patent: Jan. 24, 1995

[54] STABILIZED AND CARBONACEOUS EXPANDED FIBERS

[75] Inventors: Kyung W. Suh, Granville; William G. Stobby, Johnstown, both of Ohio; Francis P. McCullough, Jr., Lake Jackson, Tex.

[73] Assignee: The Dow Chemical Company, Midland, Mich.

[21] Appl. No.: 218,038

[22] Filed: Mar. 28, 1994

Related U.S. Application Data

[60] Continuation-in-part of Ser. No. 990,957, Dec. 15, 1992, abandoned, which is a division of Ser. No. 554,778, Jul. 19, 1990, Pat. No. 5,188,893.

[51] Int. Cl.[6] ..... D02G 3/00

[52] U.S. Cl. ..... 428/375; 428/367; 428/376; 428/398; 428/408

[58] Field of Search ..... 428/357, 362, 369, 371, 428/376, 367, 398, 221, 224, 408; 264/29.2, 29.1

[56] References Cited

U.S. PATENT DOCUMENTS

| | | | |
|---|---|---|---|
| 3,726,738 | 4/1973 | Gellon et al. | 428/359 |
| 4,347,203 | 8/1982 | Mimura et al. | 428/398 |
| 4,752,514 | 6/1988 | Windley | 428/362 |
| 4,788,093 | 11/1988 | Murata et al. | 428/398 |
| 4,837,076 | 6/1989 | McCullough, Jr. et al. | 428/408 |
| 4,879,168 | 11/1989 | McCullough, Jr. et al. | 428/357 |
| 4,950,533 | 8/1990 | McCullough, Jr. et al. | 428/369 |
| 4,950,540 | 8/1990 | McCullough, Jr. et al. | 428/362 |
| 4,959,261 | 9/1990 | McCullough, Jr. et al. | 428/312.12 |
| 5,188,893 | 2/1993 | Suh | 428/367 |
| 5,188,896 | 2/1993 | Suh et al. | 428/408 |

*Primary Examiner*—Newton O. Edwards

[57] ABSTRACT

There is provided a non-flammable expanded fiber comprising carbonaceous polymeric substantially irreversibly heat set fiber having an LOI value of greater than 40, and the fibrous structures thereof. Also, provided are stabilized expanded polymeric fibers.

7 Claims, No Drawings

STABILIZED AND CARBONACEOUS EXPANDED FIBERS

This is a continuation in-part of application Ser. No. 07/990,957, filed Dec. 15, 1992, now abandoned, which is a divisional application of Ser. No. 554,778, filed Jul. 19, 1990, now Pat. No. 5,188,893.

FIELD OF THE INVENTION

The invention resides in a resilient structure comprising linear and/or non-linear expanded stabilized and/or carbonized fibers. The carbonaceous fibers of the invention are derived from stabilized porous and/or cellular precursor fibers. More particularly, the expanded carbonaceous fibers of the present invention can be formed into permanent lightweight non-flammable resilient compressible fiber structures which have low heat conductivity and excellent thermal insulating properties.

BACKGROUND OF THE INVENTION

The prior art has prepared filaments from polymeric compositions such as polyacrylonitrile by the conventional technique of melt spinning into fibers or filaments which can be converted into multi-filament assemblies and thereafter oxidatively stabilized. Such fibers or assemblies are then subjected to carbonizing procedures to improve fire resistance.

Expanded fibers are desirable because they provide excellent feeling, bulkiness and elasticity. Crimped expanded fibers are even more desirable because the bulkiness is increased together with rapid return after compression. Such fibers find particular use as insulation for clothing, carpet material and in fiber blends for fabric.

Attempts have been made to prepare crimped aromatic fibers. U.S. Pat. No. 4,120,914, discloses the preparation of highly crimped fibers of poly(p-phenylene terephthalamide) which as a result of the mechanical crimping suffers from mechanical damages that often results in an appreciable decrease in fiber tenacity. The crimping is performed by a steam stuffer-box crimping process which produces bending strains in the fibers.

Stuffer box crimping results in sharp V-type bends in the fiber that produces excessive tension on the outer bend and severe compression on the underside. This leads to unacceptable fiber damage especially with rigid or stiff fibers.

In the Paper of Hall et al entitled "Effects of Excessive Crimp on the Textile Strength and Compressive Properties of Polyester Fibers", J. of Applied Polymer Sci, Vol. 15, p. 1539–1544 (1971), there is described the effect of forming sharp crimps on polyester fibers as well as other man-made fibers. Excessive crimping such as found in the V-type crimps leads to surface damage of the fiber and a reduction in tenacity and elongation properties.

U.S. Pat. No. 4,837,076, to Mc Cullough, Jr. et al, which is herein incorporated by reference, relates to the preparation of non-linear carbonaceous fibers and to carbonaceous fibers having different electroconductivity. This patent discloses a process which can be used to heat treat and carbonize expanded polymeric fibers to yield the fibers of the invention.

U.S. Pat. No. 4,752,514, to Windley, which is herein incorporated by reference, discloses crimped and expanded polyamide fibers. The crimps in the fiber are caused by collapsed portions. There is also disclosed a process for preparing the precursor fibers useful in the present invention.

U.S. Pat. No. 4,788,093, to Murata et al, which is herein incorporated by reference, discloses porous expanded acrylonitrile based fibers and a process for their preparation. The process can be used for preparing one of the precursor fibers of the invention.

U.S. Pat. No. 4,832,881, to Arnold Jr. et al, discloses the preparation of low density, microcellular carbon foams from polyamides, cellulose polymers, polyacrylonitrile, etc. The foams are rigid and brittle.

U.S. Pat. No. 4,193,252, to Sheppherd, et al discloses the making of partially carbonized, graphitic and carbon fibers from stabilized rayon which have been knitted into a carbon assembly. When the fabric is deknitted, the partially carbonized and the carbonized fibers contain kinks. The fully carbonized or graphite fibers have kinks which are more permanent in nature. It has now been found that partially carbonized rayon fibers are flammable, do not retain their reversible deflection and lose their kinks at relatively low temperatures or under tension.

U.S. Pat. No. 4,642,664, of Goldberg et al, which is herewith incorporated by reference, discloses the use of carbonized aromatic polyamides for use as conductors in electrical devices. However, there is only disclosed non-expanded fibers.

It is understood that the term "expanded fiber" as used herein includes porous, hollow or cellular fibers, or a combination thereof.

All percentages herein are by weight unless otherwise indicated.

The carbonaceous expanded fibers of the invention have a limited oxygen index value greater than 40, as determined by test method ASTM D 2863-77. The test method is also known as "oxygen index" or "limited oxygen index" (LOI). With this procedure the concentration of oxygen in $O_2/N_2$ mixtures is determined at which a vertically mounted specimen is ignited at its upper end and just continues to burn. The size of the specimen is $0.65 \times 0.3$ cm with a length of from 7 to 15 cm. The LOI value is calculated according to the equation:

$$LOI = \frac{[O_2]}{[O_2 + N_2]} \times 100$$

The term "stabilized" herein applies to fibers or tows which have been oxidized at a specific temperature, typically less than about 250° C. for acrylic fibers. It will be understood that in some instances the filament and/or fibers are oxidized by chemical oxidants at lower temperatures.

The term "reversible deflection" as used herein applies to a helical or sinusoidal compression spring. Particular reference is made to the publication, "Mechanical Design—Theory and Practice," MacMillan Publishing Co., 1975, pp 719 to 748, particularly Section 14–2, pp 721 to 724.

The term "carbonaceous fiber" relates to polymeric fibers whose carbon content has been irreversibly increased as a result of a chemical reaction such as a heat treatment as disclosed in U.S. Pat. No. 4,837,076, and is at least 65%.

The term "fibrous structure" as utilized herein is intended to mean an arrangement of one or more fibrous elements or materials into a complex entity such as a textile fabric which includes mats, battings, knitted, woven and non-woven materials, and the like.

The term "non-graphitic" relates to those carbonaceous fibers having an elemental carbon content of not more than 92%, are substantially free of oriented carbon or graphite microcrystals of a three dimensional order, and are as further defined in U.S. Pat. No. 4,005,183, which is herein incorporated by reference.

SUMMARY OF THE INVENTION

In accordance with the present invention there is provided expanded non-flammable non-graphitic stabilized and/or carbonaceous polymeric fibers. The fibers are expanded at least 5% greater than the fiber being non-expanded. That is, the fiber is expanded at least 5% greater than a similar fiber having its precursor fiber not expanded and when made carbonaceous is not expanded.

In accordance with one embodiment of the invention, the fibers are non-linear and have a reversible deflection of greater than 1.2:1, preferably greater than 2.0:1. The fibers can be sinusoidal or coil-like or possess a complex configuration of the two.

Advantageously, the fibers of the invention have a thermal conductivity of less than 1 BTU ft/hr ft$^2$ °F. and a char percentage greater than 65. The carbonaceous fibers have an LOI greater than 40.

The non-linear non-graphitic carbonaceous fibers can be prepared by treatment of the precursor expanded fiber in a knit/deknit process according to Pat. No. 4,837,076 or as by the apparatuses disclosed in copending applications Ser. Nos. 340,098, now Pat. No. 4,999,274 and 340,099, now Pat. No. 4,977,654 which are herein incorporated by reference.

The expanded fibers of the invention possess the good characteristics of being fire resistant and when carbonaceous, of providing a synergistic effect with respect to fire resistance when blended with other polymeric materials comparable to the non-expanded fibers of Pat. No. 4,837,076. However, the expanded carbonaceous fibers have the additional advantage over the non-expanded fibers of compressibility and bulk which results in layer volume coverage at lower weight. The presence of the pores and cells in the fibers provides the advantage of improved insulation and the capability of impregnating the article with chemical reagents or catalysts for further reactions since the fibers themselves are inert to many solvents and reagents.

As a result of the porosity, wetting agents are not normally needed when the fibers are to be utilized as reinforcements for thermosetting or thermoplastic composites.

Depending upon the particular precursor fiber and the method or degree of heat treatment, the fibers can be flexible, rigid, semi-rigid or semi-flexible, open celled or close celled.

The polymeric materials which can be utilized to prepare the precursor fibers of the invention include pitch (petroleum or coal tar), polyacetylene, acrylonitrile based materials, polyphenylene, polyvinyl chloride, polybenzimidazoles, aromatic polyamides, and the like.

DESCRIPTION OF THE PREFERRED EMBODIMENTS

The present invention provides porous and/or cellular expanded non-flammable linear and/or non-linear stabilized and/or non-graphitic carbonaceous fibers having a char percentage value greater than 65 and a thermal conductivity of less than 1 BTU ft/hr ft$^2$ °F. The carbonaceous fibers have an LOI greater than 40. The fibers can be utilized to form a fibrous structure or the precursor expanded fibers may be formed into a fibrous structure and then stabilized and/or made carbonaceous.

The expanded fibers of the invention can be linear or non-linear. The non-linear fibers have a deflection ratio of greater than 1.2:1. The density of the fibers is generally less than 2.5 gm/cc. The number of pores and the size of the pores depends on the expanding agent utilized. The resulting fibers are generally expanded at least about 5% greater than the conventional fibers. However, the upper limit has not yet been set but it is preferred to restrict the expansion under 100% for practical applications.

The porous or cellular expanded fibers of the invention include fibers having a large number of holes or cells, hollow fibers such as those having continuous voids, fibers made porous by bringing gas into the material precursor fibers during manufacture, and the like.

The expanded precursor fibers used in the present invention can be obtained according to the procedures disclosed in Pat. Nos. 4,752,514 and 4,788,093, which are herein incorporated by reference. According to one method, a spinning solution of the polymer is spun into an aqueous coagulation bath. For example, a spinning solution can be prepared with an acrylonitrile based polymer of about 3 to 100% by weight on the basis thereof of an expander compound which is soluble in the organic solvent solution of the acrylonitrile based polymer but hardly soluble or insoluble in the coagulation bath for use in the wet spinning of the polymer. The spun mixture is rinsed with water and then formed into a fiber in a dry atmosphere and held at a temperature higher than the boiling point of the expander or about 100° C., whichever is higher. The extruded fibers can be oriented by conventional means.

The organic solvents for the spinning solutions include sulfolane, N-methyl pyrrolidone, polyethylene glycol, dimethyl formamide, dimethyl acetamide, acetonitrile, acetone, etc. The concentration of the acrylonitrile based polymer is preferably 15 to 35% by weight.

The expander or blowing agent for preparing the precursor expanded fibers materials used in this invention includes those blowing agents which vaporize or otherwise generate a gas under the conditions encountered in a foaming reaction. Materials which boil under such conditions include low boiling halogenated hydrocarbons such as chlorotrifluoromethane, dichlorodifluoromethane, trichlorofluoromethane, methylene chloride, chloroform, trichloroethane, monochlorodifluoromethane, HCFC-141B ($CH_3CCL_2F$), HCFC-142B, ($CH_3CCLF_2$), HCFC-123($CF_3CHCL_2$), HCFC-124($CF_3CHCLF$), HFC-134*a* ($CF_3CH_2F$), and HFC-152*a* ($CF_3CHF_2$), $CO_2$, $N_2$ water and the like. Suitable materials which react to form a gas under such conditions are the so-called azo-blowing agents. Materials which dehydrate to release gaseous water under such conditions, including for example, magnesium sulfate heptahydrate, sodium carbonate decahydrate, sodium phosphate dodecahydrate, calcium nitrate tetrahydrate, ammonium carbonate tetrahydrate, alumina trihydrate, and the like, are preferably used as expanders. High surface area particulate solids are also useful expanders, as described in U.S. Pat. No. 3,753,933. Most preferred are water, halogenated hydrocarbons, and mixtures thereof.

A nucleating may be added to the spinning solution, for example, a metal oxide such as boron oxide, silicon oxide, aluminum oxide, metal hydroxides, cellulose esters, etc.

A sufficient amount of the expander is used to provide a cellular structure to the polymer. Preferably, the amount used provides the polymer with a density from about 0.25 to about 2, more preferably about 0.25 to 0.5 pounds per cubic foot.

According to one feature of the invention, a prepared expanded acrylonitrile based fiber is first stabilized or oxidized by placing the fiber in a preheated furnace at a temperature between 150° C. and 525° C. in air, depending upon the type of material.

The stabilized expanded fiber is then heat treated in an inert atmosphere at a temperature ranging between 425° C. to about 1500° C. for a period of time without stress or tension whereby an irreversible set chemical change occurs and the final electrical characteristics desired in the fiber is obtained.

Alternatively, a crimped expanded stabilized and/or carbonaceous fiber is obtained by processing the prepared precursor fiber according to U.S. Pat. No. 4,837,076.

The expanded polyacrylonitrile based non-graphitic carbonaceous fibers of the invention can be classified into three groups depending upon the particular use and the environment that the structures in which they are incorporated are placed.

In a first group, the nonflammable expanded carbonaceous fibers are electrically nonconductive. The term "electrically nonconductive" as used in the present application relates to carbonaceous fibers having a carbon content of greater than 65 percent but less than 85 percent and an electrical resistance of greater than $4\times10^6$ ohms/cm ($10^7$ ohms per inch) when measured on a 6K (6000 fibers) tow of fibers having a fiber diameter of from 15 to 20 microns. These fibers generally have good flexibility, compressibility and handle. They can be used in the manufacture of clothing.

When the carbonaceous fiber is derived from a stabilized and heat set expanded polyacrylonitrile based fiber, it has been found that a nitrogen content of 18 percent or higher generally results in an electrically nonconductive fiber.

In a second group, the expanded carbonaceous fibers are classified as having low electrical conductivity. These fibers have a carbon content of greater than 65 percent but less than 85 percent. The percentage nitrogen content of such fibers is generally from 16 to 20 percent. In fibers derived from a polyacrylonitrile based terpolymers, the nitrogen content may be higher. Low conductivity means that a 6K tow of fibers having a fiber diameter of from 15 to 20 microns possess a resistance of from $4\times10^6$ to $4\times10^3$ ohms/cm ($10^{-7}$ to $10^{-4}$ ohms per inch) when measured on a 6K tow of fibers having a fiber diameter of 15 to 20 microns. Such fibers can be utilized to dissipate electrostatic buildup in a composite structure.

A third group includes carbonaceous fibers having a carbon content of at least 85 percent. These fibers, as a result of their high carbon content, have a resistance of less than $10^3$ ohm/cm ($10^4$ ohms per inch) when measured on a 6K tow of fibers having a fiber diameter of 15 to 20 microns. This third group of fibers because of their high carbon content are generally rigid. However, the non-linear fibers are more flexible.

In accordance with another embodiment of the invention, the expanded fibers are prepared from an expanded aromatic polyamide fiber, or tow precursor materials. The precursor fibers may be formed by a process such as disclosed in Pat. No. 4,752,514. Specific examples of aromatic polyamides include polyparabenzamide and polyparaphenyleneterephthalamide. Polyparabenzamide and processes of preparing the same are disclosed in U.S. Pat. Nos. 3,109,836; 3,225,011; 3,541,056; 3,542,719; 3,547,895; 3,558,571; 3,575,933; 3,600,350; 3,671,542; 3,699,085; 3,753,957; and 4,025,494. Polyparaphenyleneterephthalamide (p-aramid), which is available commercially under the trademark KEVLAR , and processes of preparing the same are disclosed in U.S. Pat. Nos. 3,006,899; 3,063,966; 3,094,511; 3,575,933; 3,600,350; 3,673,143; 3,748,299; 3,836,498; and 3,827,998, among others. All of the above-cited U.S. Patents are herein incorporated by reference in their entirety. Other wholly aromatic polyamides are poly(2,7-(phenanthridone)terephthalamide, and poly(chloro-1,4-phenylene)terephthalamide. Additional specific examples of wholly aromatic polyamides are disclosed by P. W. Morgan in *Macromolecules*, Vol. 10, No. 6, pp. 1381–90 (1977), which is herein incorporated by reference in its entirety.

The expanded aromatic polyamide fibers can be stabilized or carbonized and provided with nonlinear configuration when heated in an coiled or crimped state at elevated temperatures as disclosed in copending application Ser. No. 439,300, filed Nov. 20, 1989, entitled "Nonlinear Aromatic Polyamide Fiber or Fiber Assembly and Method of Preparation now Pat. No. 4,957,807". The aromatic polyamides usually do not require stabilization before carbonization. Also, it is preferably to carbonize not more than 10% if fiber tenacity is essential.

In,the following preferred embodiments of the invention described the parts and percent mean parts by weight and percent by weight unless otherwise specified.

EXAMPLE 1

A. Preparation of Crimped Expanded Fiber.

A copolymer comprising 95% acrylonitrile and 5% vinyl chloride was dissolved in acetone. To this copolymer solution, 40% of 1,1,2-trichloro-1,2,2-trifluoroethane and 0.2% titanium dioxide were added to have the final polymer concentration adjusted to 25%; and the solution was stirred at 40° C. to yield a spinning solution. This solution was then discharged into a 20% aqueous solution of acetone at 25° through a spinneret with 10000.10 mm $\phi$ slits. After immersion therein for 9 seconds at a take-up rate of 4.5 m/min., the spun mix was immersed for 6 sec. in a 25% aqueous acetone solution at 30° C. while drawing it 1.8 times, and thereafter, crimped and heat treated at 525° C. without any tension or stress in an apparatus described in application Ser. No. 340,098 now Pat No. 4,979,274. The fiber when carbonaceous had low electrical conductivity, an expansion of about 10%, a reversible deflection ratio greater than 2:1 and an LOI greater than 40.

To prepare the linear fibers, the crimping step may be omitted. Similarly, there may be prepared expanded stabilized and/or carbonized polybenzimidazole fibers.

EXAMPLE 2

Expanded KEVLAR polyamide continuous 3K tow was prepared according to Pat. No. 4,752,514 having nominal single fiber diameters of 15 micrometer. The tow was knit on a circular knitting machine into a cloth having from 3 to 4 loops per centimeter. The cloth was heat set at 525° C. for two minutes so as to have less than a 10% increase in carbon content. When the cloth was deknitted, it produced a tow which had an elongation or reversible deflection ratio of greater than 2:1. The deknitted tow was cut into various lengths of from 5 to 25 cm, and fed into a Platt Shirley Analyzer. The fibers of the tow were separated by a carding treatment into a fluff, that is, the resulting product resembled an entangled mass of fluff in which the fibers had a high interstitial spacing,and a high degree of interlocking as a result of the non-linear configuration of the fibers.

EXAMPLE 3

A 3K tow of expanded p-aramid was knit on a circular knitting machine at a rate of 4 stitches/cm and was then heat treated at a temperature of 425° C. without stabilizing for ten minutes. The cloth was deknitted and the tow (which had an elongation or reversible deflection ratio of greater than 2:1) was cut into 7.5 cm lengths. The cut tow was then carded on a Platt Miniature carding machine to produce a resilient compressible fluff having non-linear fibers.

The fluff may be densified by needle punching, treated with thermoplastic binder such as a polyester binder, or the like, to form a mat or felt-like structure.

EXAMPLE 4

The material of Example 3 was fabricated into a thermal jacket employing about 5 ounces of the fluff as the sole fill of the jacket. The jacket had an insulating effect similar to that of a down jacket having 15–25 ounces of down as the insulating fill. If desired, the fibers may be blended with natural fibers or other synthetic linear or non-linear fibers including nylon, rayon, polyester, cotton, wool, etc.

EXAMPLE 5

Nonflammability Test

The nonflammability of the carbonaceous expanded fibers of the invention has been determined following the test procedure set forth in 14 FAR 25.853(b), which is herewith incorporated by reference. The test was performed as follows:

A minimum of three 1"×6"×6" (2.54 cm×15.24 cm×15.24 cm) carbonaceous fabric specimens were formed from foamed and stabilized polyacrylonitrile/-vinyl chloride polymer which were subsequently heat treated at about 525° C. The specimens were conditioned by placing the specimens in a conditioning room maintained at 70 degrees ±5% relative humidity for 24 hours preceding the test.

Each specimen was supported vertically and exposed to a Bunsen or Turill burner with a nominal I.D. tube adjusted to give a flame of 1 ½ inches (3.81 cm) in height by a calibrated thermocouple pyrometer in the center of the flame was 1550 degrees F. The lower edge of the specimen was ¾ inch (1.91 cm) above the top edge of the burner. The flame was applied to the center line of the lower edge of the specimens for 12 seconds and then removed.

Pursuant to the test, the material was self-extinguishing. The average after flame did not exceed 15 seconds and no flaming drippings were observed.

EXAMPLE 6

Special acrylic fiber (SAF) from Cautaulds (U.K.) was dissolved in a 25% polyethylene glycol (E-400) and 75% sulfolane mixture to obtain a 15–45% volume % polymer solution. The polymer solution was spun at a temperature between 160°–200° C. using a hollow fiber spinneret and nitrogen as a core gas. The hollow spun fibers were quenched in a water bath at about 10° C. for about 2 seconds.

The hollow fibers were then passed through a water bath at about 30° C. for about 1 minute to obtain a porous structure with greater porosity toward the inside of the hollow fibers (200 μOD/20 μID). These asymmetric porous hollow fibers were dried and then heat treated in a forced air oxidation and crosslinking reactions pursuant to U.S. Pat. No. 4,837,076. The oxidation stabilized expanded fibers had improved fire resistance and still had a good feel.

The oxidized fibers were then heat treated in a nitrogen atmosphere at a temperature of 525° C. until a 85% loss of initial polymer sample weight was achieved. The result was fire resistant carbonaceous hollow fibers.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A fibrous structure comprising a multiplicity of non-flammable expanded non-graphitic carbonaceous polymeric asymmetric porous hollow fibers, said fibers having an LOI value greater than 40, a char percentage value greater than 65, a thermal conductivity less than 1 BTU ft/hr ft$^2$°F, an elemental carbon content of less than 85 percent, said fibers being expanded at least 5% greater than the fiber being non-expanded.

2. The fibrous structure of claim 1, wherein said carbonaceous fibers comprise non-linear fibers having a reversible deflection ratio of greater than 1.2:1.

3. The fibrous structure of claim 1, wherein the fibers of said structure are derived from expanded fibers selected from the group consisting of aromatic polyamides, polybenzimidazole and polyacrylonitrile based fibers.

4. The fibrous structures of claim 1, wherein said carbonaceous fibers are non-electrically conductive.

5. The fibrous structure of claim 1, comprising a blend of expanded carbonaceous fibers and non-carbonaceous synthetic or natural fibers.

6. The fiber structure of claim 1 wherein said expanded fibers comprise asymmetric porous hollow fibers having an elemental carbon content of less than 85 percent, and having a low electrical conductivity.

7. The fiber structure of claim 1 wherein said expanded fibers comprise non-graphitic carbonaceous polyacrylonitrile based asymmetric porous hollow fibers having an elemental carbon content of less than 85 percent, and having a low electrical conductivity.

* * * * *